US005171633A

United States Patent [19]

Muramoto et al.

[11] Patent Number: 5,171,633

[45] Date of Patent: Dec. 15, 1992

[54] ELASTIC COMPOSITE FILAMENT YARN AND PROCESS FOR PREPARING THE SAME

[75] Inventors: Yasuo Muramoto; Kiyoshi Yoshimoto, both of Hofu; Masami Fujimoto, Kudamatsu; Yoshiaki Morishige, Yamaguchi, all of Japan

[73] Assignee: Kanebo, Ltd., Tokyo, Japan

[21] Appl. No.: 687,881

[22] PCT Filed: Oct. 2, 1990

[86] PCT No.: PCT/JP90/01272

§ 371 Date: May 30, 1991

§ 102(e) Date: May 30, 1991

[87] PCT Pub. No.: WO91/05088

PCT Pub. Date: Apr. 18, 1991

[30] Foreign Application Priority Data

Oct. 3, 1989 [JP] Japan ..... 1-259577
Oct. 3, 1989 [JP] Japan ..... 1-259578
Jan. 18, 1990 [JP] Japan ..... 2-7044

[51] Int. Cl.[5] ..... B23B 27/00
[52] U.S. Cl. ..... 428/374; 428/373
[58] Field of Search ..... 428/373, 378

[56] References Cited

U.S. PATENT DOCUMENTS 4,604,320 8/1986 Okamoto et al. ..... 428/290

*Primary Examiner*—Patrick J. Ryan
*Assistant Examiner*—Richard C. Weisberger
*Attorney, Agent, or Firm*—Flynn, Thiel, Boutell & Tanis

[57] ABSTRACT

A composite elastic filament yarn having excellent heat resistance is produced by conducting conjugate-spinning, in a core-sheath arrangement, preferably a concentric core-sheath arrangement, of a polyurethane, as a core component, which is crosslinked by a polyisocyanate at a crosslink density (Y) of 15 ηmol/g or more to thereby have improved heat resistance, and a non-polyurethane thermoplastic elastomer, as a sheath component, particularly a polyester elastomer, a polyamide elastomer or polystyrene elastomer, under such conditions that the core to sheath conjugate ratio (X) is in the range of from 3/1 to 100/1, and that the relationship of $Y \geqq -X+35$ is satisfied. This elastic yarn is free from tackiness and can be wound at a high speed. Further, the yarn is easy to unwind and its workability is excellent. This elastic yarn is suited for use in various fields, such as socks, tricots, panty hose, swimsuits and foundations.

12 Claims, 1 Drawing Sheet

ELASTIC COMPOSITE FILAMENT YARN AND PROCESS FOR PREPARING THE SAME

TECHNICAL FIELD

The present invention relates to an elastic core and sheath type composite filament yarn consisting of a polyurethane core component and a non-polyurethane thermoplastic elastomer sheath component, more particularly, to a novel composite elastic filament yarn which free from tackiness, an important defect of polyurethane elastomer yarns, very easy to handle in succeeding steps such as spinning, yarn processing, knitting, weaving, dyeing, finishing or the like and having excellent heat resistance, and to a process for preparing the same.

BACKGROUND ART

Polyurethane elastomer yarns have been used in diversified field with the excellent physical properties thereof being utilized. However, these yarns pose problems of tackiness, difficulties in taking-up during spinning and a low workability in succeeding steps such as various yarn processings, knitting, weaving, or the like. A measure to solve the above problems has been an approach from application of oiling agents, for example, oiling agents predominantly comprising dimethyl silicone and a metallic soap admixed therewith, oiling agents predominantly comprising mineral oil and a monoamine admixed therewith, or the like (Japanese Patent Publications Nos. 40-5,557 and 46-16,321). However, an improvement through oiling has been recognized to a certain extent but limited and imperfect. Namely, in the case of spinning and taking-up, if the tackiness of the yarns are reduced, the take-up operation tends to be unable to be continued for a long time due to cobwebbing, yarn package collapsing, etc. This tendency becomes conspicuous with an increase of the take-up speed (for example, to 500 m/min. or more) and with a decrease of the diameter of the bobbin (for example, 100 mm or less) during take-up.

On the other hand, if the yarns are made to be tacky, a long time take-up operation will be capable of being conducted, but serious troubles in succeeding steps will occur due to difficulties in yarn unwinding. Alternatively, the application of oil makes textile products uneven due to yarn tension variations caused by white powder deposition onto yarn guides, knitting needles or the like during yarn post-processing and knitting or weaving steps.

As another method for preventing the sticking of yarns, we proposed in Japanese Patent Publication No. 61-14,245, a process for preparing a core and sheath type polyurethane elastomer filament yarn consisting of a polyurethane sheath and a crosslinked polyurethane core. Such a polyurethane core and polyurethane sheath type composite elastomer filament yarn has disadvantages during taking-up at a high speed for a long time on a small diameter bobbin during spinning, unwinding in the axial direction from a bobbin as ordinary nylon or polyester yarns, and yarn handling in succeeding steps. Further, such a yarn is somewhat disadvantageous in heat resistance.

Alternatively, there have been known polyester-based elastomers as a different kind of thermoplastic elastomers. The polyester-based elastomers have been used in diversified fields because of some of the excellent properties thereof and, among other thermoplastic elastomers, have an advantage of being usable in a wide temperature range from high temperatures to low temperatures. Moreover, these elastomers have an improved load-bearing property, a high flexural fatigue resistance and excellent oil and chemical resistances. As with polyurethanes, if the proportion of hard segments is increased, the hardness thereof will increase and the elastic recovery will decrease, while if the proportion of soft segments is increased, the softness and rubbery elasticity will increase but the heat resistance will deteriorate. Elastic yarns obtained from such a polyester-based elastomer are generally required to have a high proportion of soft segments in order to have, an increased elastic recovery which, on the other hand, gives them a poor heat resistance due to a low melting point.

Further, the thus obtained yarns, since they are extremely inferior to ordinary polyurethane elastomer yarns as an elastic yarn, have not yet been put to practical use.

Furthermore, known thermoplastic polyamide-based elastomers, since they are of a light weight and have an excellent shapability, chemical resistance or the like, have so far been used in ,diversified fields, whereas fibers composed of only the elastomer have a poor elastic recovery, when the hard segments are increased and a low heat resistance when the hard segments are decreased as mentioned above, so that it is the present situation that the polyamide-based elastomers have scarcely been commercialized.

Accordingly, crimpable yarns composed of eccentric composite filaments have been reported (for example, in Japanese Patent Application Laid-open No. 58-104,220). However, these filaments themselves do not elongate along their axis and so the elastic recovery thereof as a elastic yarns is poor. Furthermore, the steps necessary to develop crimps in these filaments are so complicate that productivity is not always high.

Furthermore, polystyrene elastomers, which are known as another thermoplastic elastomer, consist of polystyrene hard segments and polybutadiene, polyisoprene or the like soft segments, and exhibit an adequate rubbery elasticity and good low temperature characteristics. However, since they have an inferior heat resistance, polystyrene elastomers have mainly been used as a modifier of engineering plastics and not for forming fibers.

As mentioned above, the polyurethane-based elastomer composite filament yarns as well as other elastic yarns obtained from the above-described thermoplastic elastomers respectively have great disadvantages and serious difficulties.

In the meanwhile, the spinning processes of polyurethane elastomer yarns are generally classified into three processes, i.e., dry-spinning, wet-spinning and melt-spinning processes. Among the other processes, the melt-spinning process has advantages such as a solvent not being required, a high spinning rate and the versatility of apparatuses used therefore, so that it is more advantageous as a commercial manufacturing process.

However, a melt-spinning process, wherein a melt-spinnable thermoplastic polyurethane is used, provides polyurethane elastomer filament yarns having a poor heat resistance and an insufficient recovery from deformation at a high temperature. Further, those yarns present problems of difficulty in unwinding due to the tackiness of the spun and taken-up yarns. In order to solve these problems, the following methods have been proposed:

(1) a method of incorporating a polyfunctional compound during polymerization, etc.;
(2) a method of direct spinning from a polymerization system;
(3) a method of melting a semi-hardened polymer and then extruding the melt at an isocyanate-setting temperature or into a hardening agent; and
(4) a method of conducting a heat treatment after spinning.

In the above, with respect to method (1), crosslinkages sufficient to improve heat resistance raise the melting temperature of the polymer and, accordingly, it becomes necessary to raise the spinning temperature, whereby the spinning is disadvantageously unstabilized.

As to method (2), control of the polymerization reaction is so difficult that problems will occur in dwelling time, heat stability or the like in the course from the polymerization system to the spinning system and, moreover, the resulting yarns having an insufficient heat resistance.

As to methods (3) and (4), though they are effective with respect to heat resistance and recovery from deformation at high temperatures of the polyurethane elastomer yarns, they can be said to be disadvantageous as commercial manufacturing methods due to their high cost since treating apparatuses of a large size are required.

Alternatively, other than the above, we have previously proposed in Japanese Patent Publication No. 58-46,573, a manufacturing process by melt-spinning of polyurethane elastomer filament yarns having an excellent heat resistance. As a result of further assiduous studies of the above proposed process and conjugate-spinning thereof in skillful combination with the aforementioned thermoplastic elastomers (excepting polyurethanes), which have so far been almost neglected in fiber use, we have succeeded in obtaining heat-resistant composite elastic filament yarns which are free from tackiness and have an excellent stretch recovery, and thus reached the present invention.

DISCLOSURE OF INVENTION

An object of the present invention is to provide a novel composite elastic filament yarn free from tackiness which is a defect inherent in polyurethane elastomer yarns, capable of taking-up for a long time during spinning and, moreover, having very excellent elastic stretchability and heat resistivity.

Another object is to provide a process for preparing by melt-spinning, an elastic filament yarn having excellent heat resistance and free from tackiness.

A further different object is to provide a process for manufacturing, with stability and industrial advantage, such a heat-resistance composite elastic filament yarn.

The composite elastic filament yarn of the present invention is a core and sheath type composite elastic filament consisting of a polyurethane, as a core component, and a non-polyurethane thermoplastic elastomer, as a sheath component, and is characterized in that a core/sheath conjugate ratio X is 3/1-100/1, preferably 10/1-70/1, more preferably 20/1-50/1, the polyurethane is crosslinked at a crosslinking density Y of at least 15 (μmol/g) and X and Y satisfy the following relationship:

$$Y \geqq -X+35.$$

The above crosslinkages of the polyurethane comprise an allophanate linkage formed mainly by polyisocyanates contained in the polyurethane.

Further, the polyisocyanates contained in the polyurethane enhances the mutual compatibility between the core component and the sheath component.

The non-polyurethane thermoplastic elastomers constituting the sheath component of the composite elastic filament of the present invention are preferably selected from the group consisting of polyester-based elastomers, polyamide-based elastomers, and polystyrene-based elastomers.

In the case where polyester-based elastomers, inter alia, are employed, the composite elastic filament yarn has a temperature-elongation characteristic of a temperature of at least 140° C. at 40% elongation under conditions of a 12.5 mg/d applied load and a temperature increasing rate of 70° C./min. Alternatively, in the case of polyamide-based elastomers, the above-said temperature is at least 130° C. Furthermore, in the case where polystyrene-based elastomers are employed, the above temperature-elongation characteristic is represented by a temperature of at least 90° C. at 40% elongation under the same conditions.

The core component may be arranged eccentrically in the sheath component. However, a concentric arrangement is most preferred.

A first manufacturing process of the composite elastic filament yarn according to the present invention is the melt-conjugate-spinning of a thermoplastic polyurethane, as a core component, along with a non-polyurethane thermoplastic elastomer, as a sheath component, and characterized by admixing a melt of said polyurethane with a polyisocyanate which is a reaction product of bifunctional and trifunctional polyol ingredients with an isocyanate ingredient and has a molar ratio of NCO groups of said isocyanate ingredient to OH groups of said polyol ingredient in the range of 1.7–4, and then conducting the conjugate-spinning.

Alternatively, a second manufacturing process according to the present invention is the melt-conjugate-spinning of a thermoplastic polyurethane, as a core component, along with a non-polyurethane thermoplastic elastomer, as a sheath component, and characterized by admixing a melt of said polyurethane with a polyisocyanate which is a reaction product of a bifunctional polyol ingredient with an isocyanate ingredient and has a molar ratio of NCO groups of said isocyanate ingredient to OH groups of said polyol ingredient in the range of 2.1–5, and then conducting the conjugate-spinning.

In these manufacturing processes, the above polyisocyanate is incorporated into the core component in an amount of preferably 10–35% by weight, more preferably 13–25% by weight.

The present invention will be explained hereinafter in more detail.

The crosslinked polyurethane of the core component constituting the present invention is not an ordinary thermoplastic polyurethane but a crosslinked polyurethane mainly comprising an allophanate crosslinked structure positively introduced thereinto.

Such a crosslinked polyurethane may be prepared according to a process wherein a polyisocyanate is reacted with a molten thermoplastic polyurethane during spinning to positively form mainly an allophanate crosslinked structure in the molecules, for example, a process we have proposed in Japanese Patent Publication No. 58-46,573.

The thermoplastic polyurethane herein referred to means, in a broad sense, a polyurethane having urethane or urea linkages in molecules thereof. Insofar as it is thermoplastic, either a linear polyurethane or a partially crosslinked polyurethane can be employed.

As a polyisocyanate to be employed in the present invention, mention may be made of a reaction product of a polyfunctional polyol having two or three hydroxyl groups, a number average molecular weight of at least 300, preferably at least 400, more preferably 800–5,000, with a polyfunctional isocyanate (for example, diphenylmethane diisocyanate, a trifunctional isocyanate, mixtures thereof or the like).

With respect to the functionality of the polyisocyanate, it is preferred to use a polyol ingredient having an average functionality of between 2.05 and 2.8 and a polyfunctional isocyanate ingredient ranging between 2.0 and 2.8.

Next, in the case where the polyol ingredients consist of those having an average functionality of only 2.0, it is preferred to make a free isocyanate group exist in the polyisocyanate, for example, so that the molar ratio of isocyanate group to hydroxyl group R may exceed 2.0. Further, when the ratio R is 2.1 or more, the heat resistance of the core component will increase, so it is advantageous.

The amount of the polyisocyanate to be added into the core component is preferred to be 10–35% by weight of a mixture of this polyisocyanate with a thermoplastic polyurethane to be spun.

According to the above, the core component having a crosslink density Y to be used in the present invention may be obtained.

The crosslink density Y herein referred to means the crosslink density of the polyurethane in the core component. For a determination of the crosslinked density, at the outset, a polyurethane sample is prepared by dissolving the sheath component in a solvent.

As a solvent for dissolving the sheath component, use may be appropriately made of ethers, such as dioxane, tetrahydrofuran or the like, phenols, such as phenol, o-chlorophenol, m-cresol or the like, and halogenated hydrocarbons, such as methylene chloride, chloroform, tetrachloroethane or the like, in the case of a polyester-based elastomer sheath component; acids, such as acetic acid, formic acid, hydrochloric acid or the like, and the above phenols, in the case of a polyamide-based elastomer; and further, toluene, xylene, cyclohexane, methylcyclohexane, methylethyl-2-tone, or the like, in the case of a polystyrene-based elastomer.

Then, a measurement is conducted according to the Yokoyama et al's method [J. Polym. Sci: Polym. Let. Ed., Vol. 17, p. 175 (1979)] and the Nakamura's method [J. Jpn. Rubber Soc., Vol. 61, No. 6, p. 430 (1988)].

Namely, 1 g of this polyurethane is introduced into a dimethylsulfoxide/methanol mixture solution and kept at 23° C. for 12 hours while stirring. Then, after dissolving at 23° C. over 24 hours, the polyurethane into a dimethylsulfoxide solution containing about 200 μmol/g of n-butylamine, the n-butylamine remaining in the reaction system is back-titrated with a 1/100 ~ 1/50 N-hydrochloric acid/methanol solution, using bromphenol blue as an indicator. The crosslink density is found by the following equations:

$$V_{01} = V_0 \times W_2 // W_1$$

$$\text{crosslink Density } (Y) = \frac{(V_{01} - V_s) \times f_{HCl} \times N_{HCl}}{1000 \times \text{Weight of Sample}} \times 10^6 (\mu\text{mol/g})$$

wherein, $W_1$ : weight of solvent in sample dissolution (g), $W_2$ : weight of solution wherein sample is dissolved (g), $V_0$ : titer required for blank test (ml), $V_{01}$ : titer required for blank test in sample dissolution (ml), $V_s$ : titer in sample dissolution (ml), $f_{HCl}$ : titer, and $N_{HCl}$ : concentration of normal solution (N).

There may be core components having a crosslink density too high to dissolve according to such a procedure as the above. However, it is needless to say that such a system can be suitably used insofar as it has a good spinnability.

Particularly, in the case where the sheath component has a high hardness and a low stretch recovery at room temperature, the core component is required to overcome the stiffness of the sheath component to develop a recovery force. Accordingly, it is preferred that the crosslink density is at least 15 μmol/g, preferably at least 20 μmol/g, more preferably at least 25 μmol/g.

Further, the present invention will be explained in more detail.

As a bifunctional polyol ingredient constituting the polyisocyanates to be applied in the present invention, suitably employed is at least one diol selected from the group consisting of polytetramethylene glycol, polypropylene glycol, polybutylene adipate diol, polycaprolactone diol, and polycarbonate diol. This bifunctional polyol is preferred to have a molecular weight of at least 400, particularly 800–5,000.

Alternatively, as a trifunctional polyol ingredient, suitably employed are polyether-based triols which are addition-polymerization products of an alkylene oxide (for example, ethylene oxide, propylene oxide or the like) polymerized in the presence of an initiator such as glycerin, trimethylol propane, hexane triol or the like; or polyester-based triols, which are polymerization products of ε-caprolactone or the like, polymerized in the presence of an organic compound such as tin, lead, manganese or the like, using trimethylol propane or the like as an initiator. Particularly, a reaction product of ε-caprolactone and trimethylol propane is preferred. This trifunctional polyol ingredient preferably has a molecular weight of at least 300.

Furthermore, polyester polyols obtained by polycondensation of a diol of a low molecular weight, such as ethylene glycol, diethylene glycol, neopentyl glycol or the like, or a triol, such as trimethylol propane, hexane triol or the like, and a dibasic acid, such as adipic acid, succinic acid, maleic acid or the like, also can be suitably employed.

The above bifunctional and trifunctional polyol ingredients may be used at an arbitrary ratio. However, a preferable ratio to bring the average functionality into the range between 2.05 and 2.8 is 95/5 ~ 20/80 by mole. In this case, if the proportion of the trifunctional polyol is too small, the ,heat resistance will become deficient and, on the other hand, if this proportion is too large, the polyisocyanate itself will become difficult to handle or the spinnability will deteriorate, so that both cases are not preferred.

As an isocyanate ingredient constituting the polyisocyanates, suitably employed may be diisocyanate compounds, such as tolylene diisocyanate, diphenylmethane diisocyanate, 1,5-naphthalene diisocyanate, xylylene diisocyanate, modified diisocyanates thereof, isophorone diisocyanate, hydrogenated p,p'-diphenylmethane diisocyanate, or the like; an adduct of trimethylol propane with 3 moles of a diisocyanate; modified carbodiimides; and further mixtures thereof or the like. Among the others, diphenylmethane diisocyanate is preferred.

In polymerizing the above polyol ingredient with the isocyanate ingredient into a polyisocyanate, the reaction may be conducted in such a manner that the NCO groups of the isocyanate ingredient may become in excess of the OH groups of the polyol ingredient, namely, the molar ratio of NCO group to OH group R may be 1.7–4.

Alternatively, in the case where the polyol ingredient consists of the above diols alone, namely, the average functionality is 2.0, it is desired to make a free isocyanate group exist in the polyisocyanate. Namely, it is necessary to maintain the ratio R within the range between 2.1 and 5. When the ratio R is less than 2.1, it is not preferred from the aspect of heat resistance, while when it exceeds 5, it is also not preferred from the aspect of workability. Furthermore, in this case, the isocyanate ingredient is preferred to have a functionality ranging between 2.0 and 2.8.

The thermoplastic polyurethanes to be employed in the present invention include any known segment polyurethane copolymers, which are polymers obtained by reaction of a polyol having a number average molecular weight of 500–6,000, such as dihydroxy polyethers, dihydroxy polyesters, dihydroxy polylactones, dihydroxy polyesteramides, dihydroxy carbonates, block copolymers thereof, or the like, and an organic diisocyanate having a molecular weight of at most 500, such as p,p'-diphenylmethane diisocyanate, tolylene diisocyanate, hydrogenated p,p'-diphenylmethane diisocyanate, tetramethylene diisocyanate, hexamethylene diisocyanate, isophorone diisocyanate, 1,5-naphthylene diisocyanate, or the like, with a chain extender, such as water, hydrazine, diamines, glycols or the like.

Among these polymers, preferable polymers are obtained by using, as a polyol, at least one diol selected from the group consisting of polytetramethylene ether glycols, polycaprolactone diols, polycarbonate diols, polyhexamethylene adipate diols, polybutylene adipate diols, polyneopentylene adipate diols, polyhexamethylene/butylene adipate copolymer diols, polycarbonate/hexamethylene adipate copolymer diols, and polyneopentylene/hexamethylene adipate copolymer diols. Alternatively, as an organic diisocyanate, p,p'-diphenylmethane diisocyanate is preferred. Further, as a chain extender, glycols or triols having a molecular weight of at most 500 are preferred. Glycols, inter alia, are particularly preferred, among which 1,4-bis(β-hydroxyethoxy)benzene and 1,4-butane diol are preferred. As the above, in the present invention, as a thermoplastic polyurethane spinning material, polymers synthesized without using a branching agent or crosslinking agent are employed in principle. Therefore, it is possible to maintain the spinning temperature on a low level and restrain the polyurethane from heat deterioration. Needless to say, polymers containing branches or crosslinkages in such an extent that the spinning temperature does not extremely rise can be suitably employed.

As a synthesis process of thermoplastic polyurethanes to be used in the present invention, either the so-called "prepolymer process" wherein a polyol is previously reacted with an organic diisocyanate compound and then further reacted with a chain extender, or the so-called "one-shot process" wherein the reaction materials are mixed together all at once can be adopted. In the polymer synthesis, solvents or diluents can be used. However, in order to manufacture polymer pellets for melt-spinning, it is more preferred to conduct bulk-polymerization. As the bulk-polymerization process, preferably employed is a process to continuously or semi-continuously collect polymers using an extruder, a process to obtain a bulky, powdery or flaky polymer by a batch reaction, or the like.

In the present invention, other than perfect thermoplastic polyurethanes obtained by sufficiently completing the polymer synthesis reaction, the so-called "imperfect thermoplastic polyurethanes", namely, pellets containing a trace of an isocyanate group remnant, can be used to form crosslinkages after shaping. However, since such pellets will present a problem of easily denaturing due to moisture, temperature, etc. during storing, the reaction-completed thermoplastic polyurethanes are more preferably employed.

These thermoplastic polyurethanes are preferred to have a Shore A hardness within the range of 60–95. If the hardness, is less than 60, there will be problems of a low recovery force or low heat resistance of the resulting yarns, so that it is not preferred On the other hand, if the hardness exceeds 95, there will be problems of poor recovery of the polyurethane itself and of a narrow range of optimum spinning conditions of the polyurethane having such a hardness, so that it is not preferred. A preferable range of the hardness is between 65 and 92.

The amount of the polyisocyanates to be added according to the present invention is 10–35% by weight, preferably 13–25% by weight, of the mixture of the thermoplastic polyurethane to be spun and the polyisocyanate. Though the loadings depend upon the kind of polyisocyanates, if the loadings are small, the improvement in thermal property of the objective polyurethane filament yarns will be insufficient. Alternatively, if the loadings are to large, uneven mixing or deterioration of yarn properties will tend to occur, whereby spinning is instabilized, so that it is not preferred.

As a thermoplastic elastomer to be used in the present invention, mention may be made of known elastomers, such as polyester-based elastomers, polyamide-based elastomers, polystyrene-based elastomers, polyolefin-based elastomers, vinyl chloride-based elastomers, or the like. Among the others, the polyester-based, polyamide-based and polystyrene-based elastomers and, inter alia, the polyester-based elastomers are preferred as a sheath component, because of their excellent melt-stability and spinnability and absence of tackiness.

The above-described polyester-based elastomers are elastomers composed of short chain ester portions as a hard segment that are formed from a aromatic dicarboxylic acid and a low molecular weight diol having a molecular weight of at most about 250, and long chain polyether portions and/or long chain polyester portions as a soft segment. For example, as an aromatic dicarboxylic acid constituting the hard segment, preferred are terephthalic acid, isophthalic acid, dibenzoic acid, substituted dicarboxylic acids having 2 benzene rings, such as bis(p-carboxyphenyl)methane, p-oxy(p-carboxyphenyl)benzoic acid, ethylene-bis(p-oxybenzoic acid), 1,5-naphthalene dicarboxylic acid, or the like. Particularly, phenylene dicarboxylic acids, such as terephthalic acid and isophthalic acid, are preferred. Alternatively, as a low molecular weight diol having a molecular weight of at most about 250, mention may be made of ethylene glycol, propylene glycol, tetramethylene glycol, hexamethylene glycol, cyclohexane dimethanol, resorcinol, hydroquinone, or the like. Particularly preferred are aliphatic diols having 2–8 carbon atoms.

Alternatively, as a long chain polyether portion constituting the soft segment, mention may be made of poly(1,2- and 1,3-propylene oxide)glycols, poly(tetramethylene oxide)glycols, random or block copolymers of ethylene oxide with 1,2-propylene oxide, or the like, having a molecular weight of 500–6,000. Poly(tetramethylene oxide)glycols are preferred.

Further, as a long chain polyester portion, mention may be made of poly(aliphatic lactone)diols, such as polycaprolactone diols, polyvalerolactone diols or the like. Particularly, polycaprolactone diols are preferred. Besides, as a long chain polyester portion, mention may be made of aliphatic polyester diols, for example, reaction products of a dibasic acid, such as adipic acid, sebacic acid, 1,3-cyclohexane dicarboxylic acid, glutaric acid, succinic acid, oxalic acid, azelaic acid, or the like, with a low molecular weight diol, such as 1,4-butane diol, ethylene glycol, propylene glycol, hexamethylene glycol, or the like. Particularly, polybutylene adipates are preferred.

Among such polyester-based elastomers, particularly preferred are polyester/ether-based elastomers composed of a hard segment of polybutylene terephthalates and a soft segment of polytetramethylene glycols having a molecular weight of 600–3,000. This is because shapability, which is the greatest feature of thermoplastic elastomers, is improved by virtue of the hard segment composed of polybutylene terephthalates having a very high crystallizing rate, and because elastomers well-balanced in properties, such as a flexural property at low temperatures, water resistance, fatigue resistance or the like, can be obtained by virtue of the soft segment composed of polytetramethylene glycols having good low temperature characteristics.

Alternatively, in order to improve weatherability and thermal aging resistance as compared with the above polyester/ether-based elastomers, particularly preferred are polyester/ester-based elastomers, namely, elastomers comprising polybutylene terephthalates as a hard segment and polycaprolactone diols having a molecular weight of 600–3,000 as a soft segment.

In order to use in the same applications as those of polyurethane elastomers, elastic properties such as elongation, stretch recovery or the like are required, so that those having a Shore D hardness of 70–35 and a crystalline melting point on DSC of at most 220° C. are preferred. The above are also preferred with respect to the manufacturing processes by melt-spinning, since it is necessary to conduct melt-spinning at the same temperature as that required for spinning the polyurethane-based elastomer as a core component. When the hardness is less than 35, problems of difficulty in take-up during spinning, etc. will arise, so that it is not preferred.

As an example of the above-described polyester-based elastomers to be preferably employed, mention may be made of commercially available ones, such as HYTREL® (manufactured by Toray-Du Pont), PELPRENE® (manufactured by Toyobo Co.), GRILUX® (manufactured by Dainippon Ink and Chemicals, Inc.), ARNITEL® (manufactured by Akzo), or the like.

Alternatively, the polyamide-based elastomers comprise hard segments and soft segments as the polyurethanes. As a hard segment, there may be used polyamide blocks such as nylon-6, nylon-11, nylon-12, nylon-66, nylon-610, nylon-612 or the like, and as a soft segment, there may be used polyether blocks such as polyethylene glycols, polypropylene glycols, polytetramethylene glycols or the like, or aliphatic polyester diols or the like. Such polyamide-based elastomers exhibit different properties depending upon polyamide materials constituting hard segments, polyethers or polyester materials constituting soft segments and the ratio of hard segments to soft segments.

For example, if the hard segment portions increase, mechanical strength, heat resistance, chemical resistance, etc. will improve but rubbery elasticity will tend to decrease, while if the hard segment portions decrease, cold resistance, softness, etc. will improve.

Further, whether the polyether-based elastomers or polyester-based ones should be employed may be decided in accordance with use of the composite filament yarns.

Particularly, it is preferred to employ nylon-12 as the hard segment when the composite filament yarns require chemical resistance, and to employ a polyether-based one as the soft segment when hydrolysis resistance is required.

Regarding the hardness, a Shore D hardness in the range of 25–70, more preferably in the range of 35–65, is desired from the aspects of physical properties and workability of the composite filament yarns.

As an example of the above-described polyamide-based elastomers to be preferably employed, mention may be made of commercially available ones, such as DAIAMID® (manufactured by Daicel-Huells), PEBAX® (manufactured by Toray Industries), GRILUX® (manufactured by Dainippon Ink and Chemicals), etc.

Alternatively, the polystyrene-based elastomers comprise hard segments and soft segments as the polyurethanes. The hard segment has a polystyrene crystal structure and the soft segment is a block copolymer of polybutadienes, polyisoprenes or polyethylene/butylene. Elastomers obtained from these can be represented by the denotations "SBS", "SIS" and "SEBS", respectively. Further, if the styrene portion increases, mechanical strength will tend to increase and hardness will also tend to increase to reduce the rubbery elasticity, and on the other hand, if the styrene portion decreases, the above tendency will be inversed.

Particularly, when the composite filament yarns require resistances to heat and weather, it is preferred to employ, as a sheath component, a saturated-type polystyrene/ethylene/butylene/styrene block-copolymer-based (SEBS) elastomer having unsaturated groups of the soft segments selectively hydrogenated.

The polyethylene-based elastomers have so far been used as adhesives and modifiers of high molecular compounds. However, since the hard segments are polystyrenes, they have inferior heat resistance, and have not been commercialized in fiber use.

In the present invention, the composite filament yarns consisting of such a polystyrene-based elastomer, as a sheath component, and a crosslinked polyurethane, as a core component, can be provided with hitherto unachieved softness as well as heat resistance.

As the above-described polystyrene-based elastomers, commercially available products can be suitably employed, such as KRATON-G® and CARIFLEX® (manufactured by Shell Chemicals), RABALON® (manufactured by Mitsubishi Petrochemical), TUFPRENE® (manufactured by Asahi Chemical Ind.), ARON-AR® (manufactured by Aron Kasei), etc.

It is preferred that the above-described thermoplastic elastomer sheath components appropriately contain light stabilizers, anti-oxidants, lubricants, delustrants such as titanium dioxide or the like, or contain additives such as electroconducting agents, antistatic agents, fungicides, fire-retardants or the like, in order to improve functions thereof. Further, modified elastomers having such functions are also preferred. Furthermore, polymer alloys or blends between the above thermoplastic elastomers or with another thermoplastic polymer may be suitably employed as sheath components.

Both, the core and sheath components have been described above and the conjugate ratio of core component to sheath component will be described below.

The core/sheath conjugate ratio X is within the range of 3/1-100/1, preferably 10/1-70/1, more preferably 20/1-50/1, by cross-sectional area.

If the proportion of the sheath component is less than 3, the obtained yarns will be deficient in elastic recovery, recovery at high temperatures and heat resistance while, on the other hand, if this proportion exceeds 100, the sheath component readily breaks to expose the core component on the surface of the filament, whereby spinnability will be badly affected, so that it is not preferred.

In order to provide the yarns with sufficient functions as a composite yarn, not only the above-described conjugate ratio but also the crosslink density of polyurethanes in the core component is important in the present invention. The core/sheath conjugate ratio X and the crosslink density Y (μmol/g) must satisfy the following relationship:

$$Y \geqq 15,$$

and $$Y \geqq -X+35.$$

Namely, in the case where the polyurethane in the core component has a low crosslink density, it is necessary to raise the proportion of the core component in the conjugate ratio X according to the above inequality. On the other hand, in the case where the polyurethane in the core component has a high crosslink density, the applicable range of the conjugate ratio can be extended, namely, the proportion of the sheath component can be increased. The filament yarns not satisfying these relationships are not preferred, since they are inferior in functions as composite filament yarns (for example, stretch recovery, heat resistance, etc.).

In the next place, as for the core/sheath conjugation shape, it may be an eccentric core and sheath type composite filament or a concentric core and sheath type composite filament. However, concentric core and sheath type composite filaments are preferred.

The cross-sectional shape of the composite filament may be circular, or non-circular such as elliptic or the like.

Further, the manufacturing process of the composite filament elastic yarns according to the present invention will be explained.

The melt-conjugate-spinning according to the present invention is preferably conducted with a melt-conjugate-spinning apparatus equipped with a thermoplastic polyurethane melt-extruding means provided with a polyisocyanate admixing means, a sheath component polymer melt-extruding means and a spinning head comprising a known type spinneret for core and sheath type melt-conjugate-spinning. As a means for admixing the polyisocyanate during spinning, known devices can be used. As the means for admixing a polyisocyanate into molten polyurethane, mixing devices having a rotary mixing element can be applied. However, a mixing device having a static mixing element is more preferably employed. As the mixing device having a static mixing element, a known device may be employed. Though the shape and number of the static mixing elements depend upon the use conditions, it is are important to select so as to allow a thorough mixing of the thermoplastic polyurethane and polyisocyanate to be completed before they are extruded from the spinneret for conjugate-spinning. Generally, 20-90 elements are provided. The core component polyurethane thus admixed with the polyisocyanate and a sheath component melted by another extruder are led to a known core/-sheath conjugation spinneret and spun to provide the composite filament yarns of the present invention.

An example of the embodiments of the present invention will be explained hereinafter. Thermoplastic polyurethane pellets are fed from a hopper and heat-melted in an extruder. The suitable temperature for melting is in the range between 190° C. and 230° C. On the other hand, a polyisocyanate is melted at a temperature of 100° C. or less in a supply tank and deformed in advance. If the melting temperature is too high, the polyisocyanate is prone to denaturation. Accordingly, a temperature as low as possible within a possible range for melting is desired., Generally, a temperature between room temperature and 100° C. is appropriately adopted. The molten polyisocyanate is metered with a metering pump, filtered with a filter if required, and then incorporated into a molten polyurethane at a core and sheath components meeting portion in the nose of the extruder. The polyisocyanate and the polyurethane are mixed with a mixer provided with a static mixing element. The mixture is metered with a metering pump and introduced into the spinning head. The spinning head is preferred to be designed to reduce extent the dwelling space for the mixture. After, if required, foreign matter is removed with a metallic net, glass beads or the like in a filter layer provided in the spinning head, the mixture is conjugated with a sheath component, i.e., a thermoplastic elastomer into a core and sheath type arrangement, extruded from the spinneret and followed by air-quenching, oil application and then taking-up. The take-up speed is generally 400-1,500 m/min.

The composite filament elastic yarns immediately after spinning and taking-up on a bobbin, sometimes may have a low strength. However, after allowing it to stand under room temperature (for example, for 2 hours to 6 days), its strength as well as stretch recovery at high temperatures improves. Further, heat-treatment after spinning by an appropriate means may promote the improvement of the yarn properties and thermal characteristics. The changes with time of the properties and thermal characteristics of the thus spun composite filament elastic yarns are conjectured to be caused by a reaction which has not yet completed during spinning and further progresses between the thermoplastic polyurethane used as a spinning material and the polyisocyanate admixed therewith in the core component. This reaction is considered to produce a polymer branched or crosslinked by allophanate linking of the polyurethane with the polyisocyanate.

Furthermore, immediately after spinning, mutual compatibility between the core and sheath components sometimes may be poor. However, this mutual compatibility improves with time or after an appropriate heat-treatment. This is considered to be caused by a reaction between the polyisocyanate and a hydroxyl, carboxyl, amino, amide or like group in the thermoplastic elastomer constituting the sheath component. Furthermore, a polystyrene-based elastomer in particular has an extremely low, fluidity when it is not in conjugation but is spun alone at a spinning temperature of, for example, 220° C. However, it is surprising that the fluidity remarkably improves, even at such a low temperature, when it is conjugate-spun with a large amount of a core component in a core and sheath arrangement as in the present invention.

Alternatively, as an oiling agent for take-up during spinning, an emulsion-based or silicone-based agent for one-stage, application, an emulsion and silicone-based agent for two-stage application, or the like, can be appropriately used.

Preferable embodiments of the present invention will be arranged and enumerated as follows:

(a) A process wherein the bifunctional polyol ingredient is at least one diol selected from the group consisting of polytetramethylene glycols, polypropylene glycols, polybutylene adipate diols, polycaprolactone diols and polycarbonate diols.

(b) A process wherein the trifunctional polyol ingredient is a reaction product of ε-caprolactone with trimethylol propane.

(c) A process wherein the isocyanate ingredient is a diisocyanate compound.

(d) A process wherein the bifunctional polyol ingredient has a molecular weight of at least 400, the trifunctional polyol ingredient has a number average molecular weight of at least 300 and said bi- and trifunctional polyol ingredients have an average functionality of 2.05–2.8.

(e) A process wherein the isocyanate ingredient is p,p'-diphenylmethane diisocyanate.

(f) A process wherein the thermoplastic polyurethane is obtained by using at least one polyol having a number average molecular weight of 500–6,000, selected from the group consisting of polytetramethylene glycols, polycaprolactone diols, polybutylene adipate diols, polyhexamethylene adipate diol, polycarbonate diols, polyneopentylene adipate diols, polyhexamethylene/butylene adipate copolymers diols, polycarbonate/hexamethylene adipate copolymers diols and polyneopentylene/hexamethylene adipate copolymers diols.

(g) A process wherein the thermoplastic polyurethane is obtained by using a glycol having a molecular weight of at most 500, as a chain extender.

(h) A process wherein the thermoplastic polyurethane is obtained by using p,p'-diphenylmethane diisocyanate as an organic diisocyanate.

(i) A process wherein the mixing is conducted with a device provided with a static mixing element.

(j) A process wherein the core and sheath components are arranged in a concentric relation.

BEST MODE FOR CARRYING OUT THE INVENTION

Figure 1:
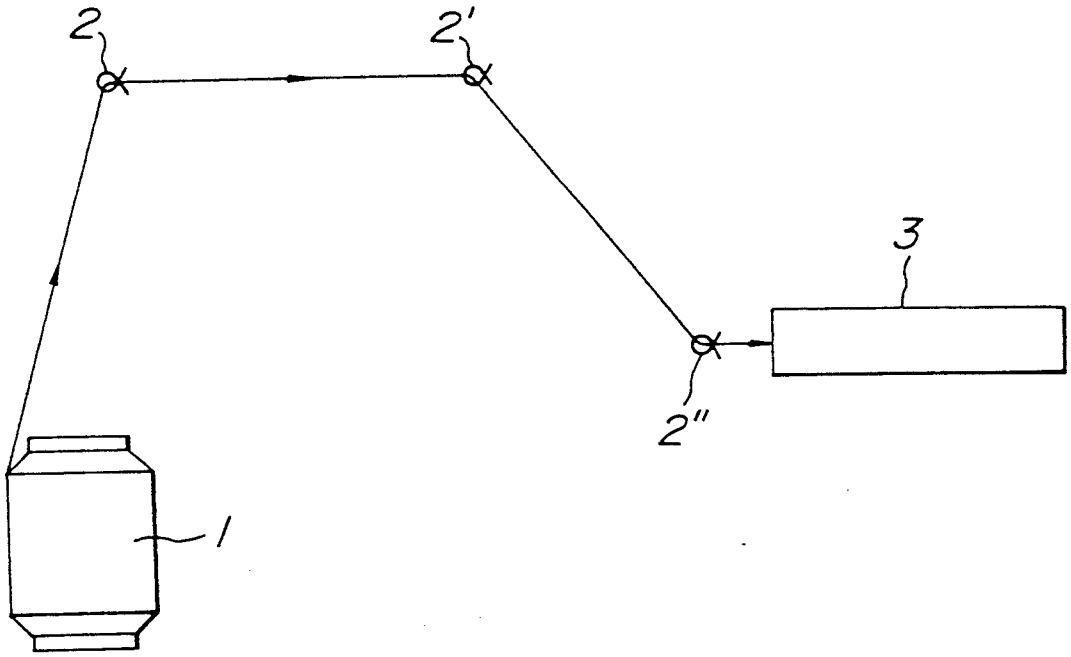
FIG. 1 is a schematic view illustrating a yarn passage when a composite elastic yarn on a bobbin is fed to a single feeder knitting machine, according to an embodiment of the present invention and a comparative example.

The present invention will be explained by way of example hereinafter. The examples are not intended to restrict the present invention.

The examples, the characteristics of the yarns were determined according to the following measuring methods on test samples taken from spun composite yarns having been left to stand at room temperature for 5 days.

(1) 190° C. heat-set elongation recovery:

A composite filament yarn elongated 30% of its original length is heat-treated to dry at 190° C. for one minute and then relaxed at room temperature. The length recovery percentage, namely, 190° C. heat-set elongation recovery is found by the following equation:

$$190^\circ\text{ C. heat-set elongation recovery (\%)} = \frac{\text{(Length at elongation)} - \text{(Set length)}}{\text{(Length at elongation)} - \text{(Original length)}} \times 100$$

In the above, let the original length be $l_0$, then the length at elongation is $1.3l_0$. Further, the set length means the length of the test sample relaxed at room temperature. Accordingly, the larger this value, the more excellent the heat resistance.

(2) Stretch recovery:

After a cycle of 100% stretch and relax at room temperature is repeated twice, the stretch recovery is represented by the value found by the following equation:

$$\text{Stretch recovery (\%)} = \frac{\text{Contractile force at 50\% elongation in the second stretch}}{\text{Tensile force at 50\% elongation in the second stretch}} \times 100$$

The larger this value, the better the recovery property.

(3) Creep temperature:

On a temperature-elongation creep curve of a yarn sample with a load of 12.5 mg/d applied and at a temperature elevation rate of 70° C./min., a temperature at 40% elongation is read. The higher the temperature, the better the heat resistance.

(4) Unwinding coefficient:

When a composite filament yarn is unwound at a rate of 50 m/min. from a yarn package onto a take-up bobbin, the unwinding coefficient is represented by a surface speed ratio of the bobbin to the yarn package when the unwinding becomes impossible due to sticking to the surface of the yarn package. The larger this value, the more the tackiness of the yarn.

(5) Take-up continuable time:

A period of time during which a composite filament yarn can be taken-up without cobwebbing or yarn package collapsing.

(6) Knitting step:

With a single feeder knitting machine (with latch needles), a composite filament yarn unwound from a bobbin was passed through yarn guides and knitted at a rate of 200 r.p.m.

In FIG. 1, yarn on a bobbin 1 was fed via yarn guides 2, 2' and 2'' to a single feeder knitting machine 3. Accordingly, the yarn was dragged out by knitting needles. For evaluation, the followings were observed:

Operability: yarn breakage until a hose 10 cm long had been knitted (◎ denotes no yarn breakage).

Knit texture: intensity and repetition of barré (◎ denotes no barré).

EXAMPLE 1 AND COMPARATIVE EXAMPLE 1

(1) Core component

① Thermoplastic Polyurethane

A kneeder provided with a jacket was charged with 3,410 parts of a dehydrated polycaprolactone diol having a number average molecular weight of 1,950 and 295 parts of 1,4-butane diol. After thoroughly dissolving while stirring, 1,295 parts of p,p'-diphenylmethane diisocyanate was added thereto and reacted as the temperature was kept at 85° C. The obtained reaction product was taken out of the kneeder and shaped into pellets with an extruder. This shaped body had a relative viscosity of 2.27 measured at a concentration of 1 g/100 cc in dimethyl formamide at 25° C.

② Polyisocyanate

A mixture of 820 parts of a dehydrated polycaprolactone triol having a number average molecular weight of 1,249 and 559 parts of a trifunctional polycaprolactone diol (the trade mark: PLACCEL ® 308, manufactured by Daicel Chemical Ind.) having a number average molecular weight of 1,989 with 621 parts of p,p'-diphenylmethane diisocyanate, which had a bifunctional/trifunctional ratio of the polyol ingredients of 70/30 (by mole: a calculated functionality of 2.3) and an R ratio of 2.3, were reacted at 80° C. over about 2 hours and a viscous polyisocyanate compound was obtained. Further, this compound was defoamed by vacuumization.

(2) Sheath Component

As a sheath component, a polyester/ether-based elastomer, HYTREL ® 4047 (Shore D hardness: 40, manufactured by Toray-Du Pont, Co.), was used.

On the one hand, when the above-described thermoplastic polyurethane for the core component was melted, the polyisocyanate compound was injected thereinto with a feeding device and both compounds were mixed by means of a mixing device having 30 static mixing elements to form a core component. On the other hand, the above-described sheath component was melted with an extruder. These components were introduced into a spinneret for concentric core/sheath conjugate-spinning (orifice diameter: 0.5 mm) and spun out, varying the core/sheath conjugate ratio and crosslink density. The spun filament was taken-up at a take-up rate of 600 m/min. on a paper bobbin having an outside diameter of 85 mm and a 40 denier composite monofilament elastic yarn was obtained. Additionally, as an oiling agent, an emulsion for polyester knits was used. The results are shown in Table 1.

Using the above-described thermoplastic polyurethane instead of HYTREL ® as the sheath component, a core and sheath type composite filament was obtained with the same apparatus and conditions as above. The results are also shown in Table 1, as Comparative Examples 1-3 and 1-4. Additionally, oiling agents used in Comparative Examples 1-3 and 1-4 mainly comprised a dimethyl silicone admixed with an aminomodified silicone as an NCO deactivator in amounts of 0.3% and 0.5%, respectively (in the case of the oiling agent admixed with 5% of the amino-modified silicone, filament sticking was not observed).

TABLE 1

| | Comparative Example | | Example | | Comparative Example | | | | Example | | |
|---|---|---|---|---|---|---|---|---|---|---|---|
| Test No. | 1-1 | 1-2 | 1-1 | 1-2 | 1-3 | 1-4 | 1-5 | 1-6 | 1-3 | 1-4 | 1-5 |
| Core/sheath conjugate ratio (X) | 1 | 2 | 10 | 20 | 20 | 20 | 10 | 10 | 10 | 40 | 70 |
| Crosslink density of core component (μmol/g) | >40 | >40 | >40 | >40 | >40 | >40 | 0 | 11 | 40 | 39 | 39 |
| Tensile strength (g/d) | 1.10 | 1.25 | 1.65 | 1.75 | 1.68 | 1.68 | 1.08 | 1.52 | 1.71 | 1.78 | 1.69 |
| Elongation (%) | 592 | 574 | 555 | 532 | 557 | 557 | 692 | 615 | 552 | 549 | 525 |
| 300% Stress (g/d) | 0.25 | 0.31 | 0.58 | 0.60 | 0.43 | 0.43 | 0.21 | 0.23 | 0.54 | 0.56 | 0.58 |
| Stretch recovery (%) | 67 | 72 | 83 | 85 | 88 | 88 | 66 | 70 | 82 | 86 | 88 |
| Creep temperature (°C.) | 127 | 138 | 178 | 182 | 184 | 184 | 102 | 123 | 176 | 181 | 183 |
| 190° C. Heat-set elongation recovery (%) | 0 | 0 | 23 | 33 | 37 | 37 | Un-measurable | 0 | 17 | 23 | 33 |
| Unwinding coefficient | 1.00 | 1.00 | 1.00 | 1.00 | 1.15 | 1.00 | 1.00 | 1.00 | 1.00 | 1.00 | 1.00 |
| Take-up continuable time (Hr) | ≧5 | ≧5 | ≧5 | ≧5 | ≧5 | 0.4 | ≧5 | ≧5 | ≧5 | ≧5 | ≧5 |
| Knitting property | | | | | | | | | | | |
| Operability | ◎ | ◎ | ◎ | ◎ | xx | x | Δ | ◎ | ◎ | ◎ | ◎ |
| Knit texture | ◎ | ◎ | ◎ | ◎ | — | x | ◎ | ◎ | ◎ | ◎ | ◎ |

From Table 1, it is found that the heat resistance and stretch recovery of the obtained composite elastic filament increase with an increase of the conjugate ratio, namely, with an increase in the proportion of the core component. In the cases of Comparative Examples 1-3 and 1-4, take-up could be conducted when the filament was tacky as Comparative Example 1-3, whereas the yarn package collapsed after 24 minutes when the unwinding coefficient was 1.00, namely, the filaments were free from tackiness, as Comparative Example 1-4.

The filament yarns of Comparative Examples 1-3 and 1-4 were rewound and then knitted. In Comparative Example 1-4, when rewinding, the yarn could not unwind smoothly due to cobwebbing and yarn breakages caused thereby. In Comparative Example 1-3, knitting could not be conducted despite the lack of cobwebbing during rewinding.

Further, it is found that the heat resistance improves with an increase in the crosslink density in the core component. The filaments of Examples 1-2, 1-4 and 1-5 exhibit as substantially good physical properties as the polyurethane-based composite elastic yarns (Comparative Examples 1-3 and 1-4). The yarns of the present invention are free from tackiness and, moreover, the shape of the yarn packages was good. Further, separation of the core component from the sheath component was not observed. Furthermore, it is seen that the knitting property is very good. Accordingly, the composite filament yarns of the present invention is suitable for use in swimsuit.

EXAMPLES 2~4

Using the same thermoplastic polyurethane as Example 1, spinning was conducted in the same manner as Example 1 except that the polyol ingredients were varied as shown in Table 2 so that the polyisocyanate might have an R ratio of 2.3. Additionally, the core/sheath conjugate ratio X was fixed at 20 and the amount of the polyisocyanate was fixed at 18%. The results are shown in Table 2.

TABLE 2

| Test No. | Example 2 | Example 3 | Example 4 |
|---|---|---|---|
| Bifunctional/trifunctional molar ratio and average functionality of polyol ingredient | 80/20<br>2.2 | 65/35<br>2.35 | 50/50<br>2.5 |
| Crosslink density of core component (μmol/g) | 26 | >40 | >40 |
| Tensile strength (g/d) | 1.47 | 1.66 | 1.75 |
| Elongation (%) | 559 | 523 | 500 |
| 300% Stress (g/d) | 0.39 | 0.60 | 0.60 |
| 190° C. heat-set elongation recovery (%) | 13 | 33 | 37 |
| Creep temperature (°C.) | 168 | 181 | 185 |

From Table 2, it is found that when the functionality of the polyol in the polyisocyanate increases, the crosslink density of the core component increases and, at the same time, the heat resistance improves.

COMPARATIVE EXAMPLES 2 AND 3

An elastic single component filament consisting of the same component as the core component in Example 2 was spun and applied with a polyether-based emulsion oiling agent before take-up (Comparative Example 2). Alternatively, an elastic filament was manufactured in the same manner as above, except that an oiling agent comprising predominantly dimethyl silicon admixed with 5% by weight of an amino-modified silicone, as an NCO deactivator, was used (Comparative Example 3).

The elastic yarn of Comparative Example 2 encountered frequent difficulties in unwinding due to sticking. Alternatively, the elastic yarn of Comparative Example 3 was frequently broken due to yarn package collapse during take-up.

EXAMPLES 5 AND 6, AND COMPARATIVE EXAMPLE 4

(1) Core Component

① Thermoplastic Polyurethane

A kneader provided with a jacket was charged with 9,324 parts of a dehydrated polyhexamethylene adipate diol having a number average molecular weight of 1,934 and 888 parts of 1,4-butane diol and thoroughly dissolved while stirring. The solution, maintained at a temperature of 85° C., was then added and reacted with 3,752 parts of p,p'-diphenylmethane diisocyanate.

The resulting reaction product was taken out of the kneader and shaped into pellets with an extruder. This shaped body had a relative viscosity of 2.33 in dimethyl formamide at 25° C.

② Polyisocyanate

In a kettle equipped with a stirrer, 2,532 parts of p,p'-diphenylmethane diisocyanate was dissolved at 80° C. and admixed with 3,468 parts of a dehydrated polycaprolactone diol having a number average molecular weight of 855. The reaction was conducted for about 60 min. and a viscous polyisocyanate having an R ratio of 2.50 was obtained. Further, this compound was defoamed by vacuumization.

(2) Sheath Component

Alternatively, as a sheath component, a polyester/ether-based elastomer, PELPRENE® (Shore D hardness: 52, manufactured by Toyobo Co.) was employed.

The polyisocyanate was injected with a feeding device thereof when the above-described polyurethane-based elastomer, as one ingredient of the core component, was melted. Both ingredients were mixed by a mixing device provided with 40 static mixing elements to produce a core component. On the other hand, the above sheath component was melted with an extruder. Both components were introduced into a spinneret for concentric core/sheath conjugate-spinning (having a core/sheath cross-sectional area ratio of 16 and an orifice diameter of 0.5 mm), spun and taken-up at a take-up speed of 500 m/min. on a paper bobbin having an outside diameter of 85 mm. Thus, a 40 denier/2 filament, composite elastic filament yarn was obtained. Additionally, as an oiling agent, an emulsion for polyester knits was used, Spinning was conducted with the amount of the polyisocyanate to be added to the core component being varied, so as to provide crosslink densities shown in Table 3. The results are shown in Table 3. Further, spinning was attempted to be conducted with a core component having a polyisocyanate in an amount of 40% (Comparative Example 5), and then take-up was found impossible due to lack of stringiness.

From Table 3, it is found that in the case where the polyisocyanate was not added (Comparative Example 4), the 190° C. heat-set elongation recovery could not be measured due to the melting of samples during measuring, while the addition of the polyisocyanate before spinning greatly improved the 190° C. heat-set elongation recovery, and the creep temperature rose with an increase in the crosslink density, so that the heat resistance greatly improved. Further, sticking of the yarn of the present invention was not observed at all.

TABLE 3

| Test No. | Example 4 | Example 5 | Example 6 |
|---|---|---|---|
| Crosslink density of core component (μmol/g) | 0 | 28 | 38 |
| Tensile strength (g/d) | 0.94 | 1.51 | 1.53 |
| Elongation (%) | 595 | 522 | 504 |
| 300% Stress (g/d) | 0.20 | 0.43 | 0.52 |
| 190° C. heat-set elongation recovery (%) | un-measurable | 7 | 13 |

TABLE 3-continued

| Test No. | Example 4 | Example 5 | Example 6 |
|---|---|---|---|
| Creep temperature (°C.) | 105 | 167 | 180 |

EXAMPLES 7~9, AND COMPARATIVE EXAMPLE 6

Using the same thermoplastic polyurethane elastomer and the same equipment as Example 5, spinning was conducted in the same manner as Example 5, except that the polyisocyanate obtained from the same starting material composition as Example 5 but had an R ratio varied as shown in Table 4. Additionally, the amount of the polyisocyanate to be added was fixed at 19% by weight.

TABLE 4

| Test No. | Example 6 | Example 7 | Example 8 | Example 9 |
|---|---|---|---|---|
| R ratio | 2.00 | 2.25 | 2.40 | 2.75 |
| Crosslink density of core component (μmol/g) | 11 | 26 | 35 | 39 |
| Tensile strength (g/d) | 1.35 | 1.55 | 1.59 | 1.76 |
| Elongation (%) | 566 | 521 | 499 | 472 |
| 300% Stress (g/d) | 0.35 | 0.48 | 0.52 | 0.55 |
| 190° C. heat-set elongation recovery (%) | 0 | 3 | 10 | 23 |
| Creep temperature (°C.) | 121 | 152 | 178 | 183 |

From Table 4, it is found that with an increase of the R ratio, namely, with an increase of free diisocyanates, the crosslink density of the core component, as well as the 190° C. heat-set elongation recovery and creep temperature, increased, so that the heat resistance greatly improved. Further, this yarn was tackiness-free and could also be drawn out from the yarn package in an axial direction thereof. Examples 10 and 11, and Comparative Examples 7~9

(1) Core Component

① Thermoplastic Polyurethane

A thermoplastic polyurethane was synthesized according to a conventional process, using 5,798 parts of a polybutylene adipate having a number average molecular weight of 1,950, 2,571 parts of p,p'-diphenylmethane diisocyanate and, as a chain extender, 631 parts of 1,4-butane diol. This polyurethane had a relative viscosity of 2.15 in a dimethyl formamide solution at 25° C.

② Polyisocyanate

A polyisocyanate was obtained by reacting 1,149 parts of a polycaprolactone diol having a number average molecular weight of 1,250 and 203 parts of a polycaprolactone triol having a number average molecular weight of 1250 (an average functionality of the polyol ingredients of 2.15) with 648 parts of p,p'-diphenylmethane diisocyanate.

The NCO content of this compound was 6.0% by weight.

(2) Sheath Component

Polyamide-Based Elastomer

DIAMID ®-E47 having a Shore D hardness of 47 (manufactured by Daicel-Huells) was employed.

When the above-described thermoplastic polyurethane was melted, the above polyisocyanate was injected thereinto with a known feeding device and both compounds were mixed by means of a static mixer having 45 static mixing elements (made by Kenics) to form a core component. On the other hand, the above-described polyamide-based elastomer was melted with a separate extruder. These components were metered separately and introduced into a spinneret for concentric core/sheath conjugate-spinning (orifice diameter: 0.5 mm) and spun out. The spun filament was taken-up at a take-up rate of 600 m/min. on a bobbin having an outside diameter of 85 mm and a 40 denier composite monofilament was obtained.

In this case, the core/sheath conjugate ratio was 19 and the amount of the polyisocyanate was varied so as to provide the crosslink densities in the core components shown in Table 5. As an oiling agent, an emulsion for polyamide filaments was used.

In the next place, changing the sheath component from the polyamide-based elastomer to the above-described thermoplastic polyurethane and a conjugate-spinning was conducted in the same manner.

The spun yarns were applied with oiling agents comprising, predominantly, dimethyl silicone and 5% and 0.3%, by weight, of amino-modified silicone as an isocyanate deactivator, respectively, before take-up (Comparative Examples 7 and 8).

The results are shown in Table 5.

TABLE 5

| Test No. | Comparative Example 7 | Comparative Example 8 | Comparative Example 9 | Example 10 | Example 11 |
|---|---|---|---|---|---|
| Crosslink density of core component (μmol/g) | 25 | 25 | 12 | 20 | 32 |
| Tensile strength (g/d) | 1.62 | 1.62 | 0.81 | 1.15 | 1.25 |
| Elongation (%) | 531 | 501 | 589 | 542 | 525 |
| 300% Stress (g/d) | 0.45 | 0.45 | 0.31 | 0.35 | 0.45 |
| Stretch recovery (%) | 86 | 86 | 78 | 83 | 86 |
| Creep temperature (°C.) | 33 | 33 | 0 | 3 | 13 |
| 190° C. Heat-set elongation recovery (%) | 181 | 181 | 123 | 179 | 181 |
| Unwinding coefficient | 1.00 | 1.13 | 1.00 | 1.00 | 1.00 |
| Take-up continuable time (Hr) | 0.3 | ≧5 | ≧5 | ≧5 | ≧5 |
| Knitting property | | | | | |
| Operability | X | Un-knittable | Δ | ◎ | ◎ |
| Knit texture | Δ | — | ◎ | ◎ | ◎ |

For measurements of characteristics in the knitting step, with respect to the yarns of Comparative Examples 7 and 8, yarns after rewinding were used as a test sample.

Table 5 shows that when the tackiness was eliminated as the polyurethane-polyurethane type filament of Comparative Example 7, the take-up continuable time was no more than 18 min. due to cobwebbing. On the other hand, when the filament was tacky as Comparative Example 8, the take-up property improved but this filament required a rewinding step.

Though the yarn of Comparative Example 7 was rewound, the shape of the formed yarn package was not good due to cobwebbing, so that the knit operability was in such a low condition that the yarn could not be unwound smoothly and frequently broke. Alternatively, the yarn of Comparative Example 8 could not be knitted, notwithstanding the conducting of rewinding.

Also, it is found in Comparative Example 9 that the yarn having a crosslink density of 12 μmol/g had a low tensile strength and heat resistance. Further, the knit operability of this yarn was low due to its low strength and frequent yarn breakages caused thereby.

It is understood from Examples 10 and 11, that the filaments of the invention had a core component with a high crosslink density, exhibited excellent tensile strength, heat resistance and spinning and taking-up workabilities, and showed a very good result also in the knitting step.

EXAMPLES 12~14, AND COMPARATIVE EXAMPLE 11

Example 10 was followed, except that the under-described polyisocyanate was employed. Additionally, the conjugate ratio was varied as shown in Table 6 and the amount of the polyisocyanate was fixed at 16%.

Polyisocyanate

A viscous compound was obtained by reacting 74.4 parts of POLYLITE®-OD-X-106 (functionality of 2.43, manufactured by Dainippon Ink and Chemicals, Inc.) that is, a mixture of a bifunctional polyol and a trifunctional polyol, having a molecular weight of 2,200, with 25.5 parts of MDI. This compound had an NCO content of 5.2% by weight.

The results are shown in Table 6. Additionally, the crosslink density of the core components in Comparative Example 11 and Examples 12~14 were more than 40 μmol/g.

TABLE 6

| Test No. | Example 12 | Example 13 | Example 14 |
|---|---|---|---|
| Core/sheath conjugate ratio (X) | 10 | 25 | 50 |
| Tensile strength (g/d) | 1.41 | 1.49 | 1.59 |
| Elongation (%) | 550 | 523 | 509 |
| 300% Stress (g/d) | 0.44 | 0.46 | 0.48 |
| 190° C. heat-set elongation recovery (%) | 13 | 23 | 37 |
| Creep temperature (°C.) | 178 | 180 | 185 |

From Table 6, it is found that the heat resistance is greatly improved by increasing the conjugate ratio. Additionally, when Example 12 was followed, except that the thermoplastic polyurethane of Example 10 was employed for the sheath component and an oiling agent for making tackiness-free was applied before take-up, the take-up could continue no more than 25 min. (Comparative Example 11).

EXAMPLES 15~17, AND COMPARATIVE EXAMPLE 12

(1) Core Component

① Thermoplastic Polyurethane Elastomer

A thermoplastic polyurethane elastomer was synthesized according to a conventional process, using 2,740 parts of a polytetramethylene glycol having a number average molecular weight of 1,050, 1,000 parts of p,p'-diphenylmethane diisocyanate and, as a chain extender, 260 parts of 1,4-bis(β-hydroxyethoxy) benzene. This elastomer had a relative viscosity of 2.15 in dimethyl formamide.

② Polyisocyanate

A polyisocyanate was obtained by reacting 1,594 parts of a polycaprolactone diol having a number average molecular weight of 1,250 and 450 parts of a polycaprolactone triol having a number average molecular weight of 2,000 (average functionality of the polyol ingredient=2.15) with 957 parts of p,p'-diphenylmethane diisocyanate. This compound had an NCO content of 6.2% by weight.

(2) Sheath Component

Polystyrene-Based Elastomer

"KRATON®-G1557" manufactured by Shell Chemicals (an SEBS type copolymer) was employed.

When the above-described thermoplastic polyurethane was melted, the above polyisocyanate compound was injected thereinto with a known feeding device and both compounds were mixed by means of a static mixer having 40 static mixing elements (made by Kenics) to form a core component. On the other hand, the above-described polystyrene-based elastomer was melted with a separate extruder. These components were metered separately and introduced into a spinneret for concentric core/sheath conjugate-spinning (orifice diameter: 0.5 mm) and spun out. The spun filament was taken-up at a take-up rate of 600 m/min. on a bobbin having an outside diameter of 85 mm and a 40 denier composite monofilament was obtained.

In this case, the amounts of the core and sheath, and the amount of the polyisocyanate were varied so as to provide the conjugate ratios and the crosslink densities in the core components shown in Table 7.

TABLE 7

| Test No. | Comparative Example 12 | Example 15 | Example 16 | Comparative Example 13 | Example 17 |
|---|---|---|---|---|---|
| Core/sheath conjugate ratio (X) | 2 | 6 | 12 | 12 | 30 |
| Crosslink density of core component (μmol/g) | 30 | 31 | 26 | 8 | 27 |
| Tensile strength (g/d) | 0.78 | 1.09 | 1.32 | 0.93 | 1.52 |
| Elongation (%) | 673 | 568 | 553 | 629 | 529 |
| 300% Stress (g/d) | 0.15 | 0.20 | 0.23 | 0.19 | 0.25 |
| Stretch recovery (g/d) | 93.9 | 95.2 | 94.2 | 94.9 | 93.9 |
| Creep temperature (°C.) | 72 | 127 | 130 | 83 | 140 |

From Table 7, it is found that in the case where the conjugate ratio X is less than 3 or the relationship:

Crosslink density $Y \geqq -(\text{conjugate ratio } X)+35$, is not satisfied as Comparative Examples 12 or 13, the creep temperature is lower as compared with the other examples, so that the heat resistance is low. It is further found from Examples 15~17 that the 300% stress is extremely low, so that the heat resistance is sufficiently high.

It is also found that the yarns of the present invention obtained in the above Examples have a very high recovery, so that they are soft and excellent in stretch recovery. Particularly with respect to heat resistance, such a high value is in no way conceivable in polystyrene-based elastomer single-component yarns.

Meanwhile, though the core/sheath compatibility was poor immediately after spinning it very much improved with time, for example, after standing at room temperature for 6 days or so.

INDUSTRIAL APPLICABILITY

As explained above, since the composite filament elastic yarns according to the present invention are composed of a polyurethane crosslinked by a polyisocyanate, as a core component, and a non-polyurethane elastomer, such as a polyester-based, polyamide-based or polystyrene-based elastomer or the like, as a sheath component, they have features such that they are free from tackiness inherent in ordinary polyurethane elastomer yarns and can be taken-up in the same manner as ordinary nylon or polyester yarns, or the like. Namely, the yarns of the present invention can be taken-up at a high speed onto a bobbin of a small diameter. Moreover, since no rewinding is required, the yarns can be suited for employment in succeeding steps as they are. Further, they have a performance such that drawing out from yarn packages in the axial direction thereof can be conducted, which cannot be done by ordinary Spandex®. Then, with respect to other properties, such as heat resistance, since the core component is composed of a thermoplastic polyurethane polymer crosslinked with a polyisocyanate compound, the heat resistance is high.

For example, as to an elongation-temperature creep behavior, when the creep property of the yarns is measured under conditions of a temperature increasing rate of 70° C./min. and a load of 12 mg/d applied, the yarns of the present invention exhibit an excellent heat resistance, such as a temperature at 40% elongation of at least 140° C. in the case of a polyester-based elastomer sheath, at least 130° C. in the case of a polyamide-based elastomer sheath and at least 90° C. in the case of a polystyrene-based elastomer sheath. This is surprising when it is compared with the fact that the above temperature is about 100° C. in the case of a polyester-based elastomer single-component yarn having a Shore D hardness of 40.

Further, the yarns of the present invention never melt or break, even when the yarns, which have been elongated 30% at room temperature, are placed in an air atmosphere at 190° C. for 1 minute and then relaxed at room temperature.

Further, the core and sheath components have a good mutual compatibility by virtue of an interfacial reaction therebetween, so that no separation is observed upon an abrasion test.

Furthermore, composite filaments comprising a polystyrene-based elastomer sheath component have a very low 300% stress, for example, of 0.2 g/d. This is difficult for composite filaments comprising a polyurethane sheath component.

Since it is a melt-spinning process, the process of the present invention is more advantageous as a commercial manufacturing process than other spinning processes (for example, a dry-spinning process). The process of the invention also has meritorious features in commercial production, such as availability of non-expensive emulsion-based oiling agents.

The yarns of the present invention, either alone or in combination with nylon yarn or the like, as a covering yarn, can be suited for use wherein hitherto marketed, conventional polyurethane elastic yarns have been employed, particularly in the field where heat resistance is required in manufacturing processes, for example, socks, tricots, panty hose, swimsuits, foundations or the like.

We claim:

1. A core and sheath type composite elastic filament yarn composed of a polyurethane, as a core component, and a non-polyurethane thermoplastic elastomer, as a sheath component, characterized in that a core/sheath conjugate ratio (X) is 3/1 to 100/1, said polyurethane is crosslinked at a crosslink density (Y) of at least 15 ηmol/g and said core/sheath conjugate ratio (X) and said crosslink density (Y) satisfy the following relationship:

$$Y \geqq -X+35.$$

2. The composite elastic filament yarn according to claim 1, wherein said polyurethane is crosslinked mainly by allophanate linkages derived by a polyisocyanate contained in said polyurethane.

3. The composite elastic filament yarn according to claim 1, wherein said conjugate ratio (X) is 10/1 to 70/1.

4. The composite elastic filament yarn according to claim 3, wherein said conjugate ratio (X) is 20/1 to 50/1.

5. The composite elastic filament yarn according to claim 1, wherein said non-polyurethane thermoplastic elastomer is a polyester-based elastomer.

6. The composite elastic filament yarn according to claim 1, wherein said non-polyurethane thermoplastic elastomer is a polyamide-based elastomer.

7. The composite elastic filament yarn according to claim 1, wherein said non-polyurethane thermoplastic elastomer is a polystyrene-based elastomer.

8. The composite elastic filament yarn according to claim 1, wherein said core component and sheath component are arranged in a concentric relation with each other.

9. The composite elastic filament yarn according to claim 1, wherein a polyisocyanate is incorporated into the core component to enhance the compatibility between the core component and the sheath component.

10. The composite elastic filament yarn according to claim 5, wherein said yarn has a temperature-elongation characteristic of 40% elongation at a temperature of at least 140° C., a load of 12.5 mg/d and a temperature increasing rate of 70° C.

11. The composite elastic filament yarn according to claim 6, wherein said yarn has a temperature-elongation characteristic of 40% elongation at a temperature of at least 130° C., a load of 12.5 mg/d and a temperature increasing rate of 70° C.

12. The composite elastic filament yarn according to claim 7, wherein said yarn has a temperature-elongation characteristic of 40% elongation at a temperature of at least 90° C., a load of 12.5 mg/d and a temperature increasing rate of 70°0 C./min.

* * * * *

UNITED STATES PATENT AND TRADEMARK OFFICE

CERTIFICATE OF CORRECTION

PATENT NO. : 5 171 633

DATED : December 15, 1992

INVENTOR(S) : Yasuo MURAMOTO et al

It is certified that error appears in the above-identified patent and that said Letters Patent is hereby corrected as shown below:

Column 24, line 58; change "70°C." to ---70°C/min.--- line 67; change "70°0 C./min." to ---70°C/min.---

Signed and Sealed this

Twenty-first Day of December, 1993

*Attest:*

*Attesting Officer*

BRUCE LEHMAN

*Commissioner of Patents and Trademarks*